United States Patent [19]

Murata

[11] 4,266,804

[45] May 12, 1981

[54] SKI BRAKING DEVICE

[75] Inventor: Masahiro Murata, Matsudo, Japan

[73] Assignee: Hope Co., Ltd., Tokyo, Japan

[21] Appl. No.: 92,097

[22] Filed: Nov. 7, 1979

[30] Foreign Application Priority Data

Dec. 29, 1978 [JP] Japan ..... 53-181675[U]

[51] Int. Cl.[3] ..... A63C 7/10

[52] U.S. Cl. ..... 280/605

[58] Field of Search ..... 280/604, 605; 188/5

[56] References Cited

U.S. PATENT DOCUMENTS 4,173,354 11/1979 Murata ..... 280/605

FOREIGN PATENT DOCUMENTS 2726023 3/1978 Fed. Rep. of Germany ..... 280/605

2751602 5/1979 Fed. Rep. of Germany ..... 280/605

*Primary Examiner*—David M. Mitchell

*Assistant Examiner*—Michael Mar

*Attorney, Agent, or Firm*—Wenderoth, Lind & Ponack

[57] ABSTRACT

A ski braking device is provided which includes a base plate, a brake member which is rotatably supported by the base plate, a pedal member connected to the brake member, and a metal member which extends from the base plate into a hollow space located in the pedal member. The metal member is made up by a metal rod and includes a first end portion which is rotatably supported by the base plate and a second free end portion which extends into the hollow space in the pedal member and which is hooked or bent toward the side edge of the ski plate. The pedal member includes first and second elastic pressure exerting members which are located in the hollow space which sandwich the second free end portion of the metal member between them.

5 Claims, 8 Drawing Figures

SKI BRAKING DEVICE

BACKGROUND OF THE INVENTION

This invention relates to a ski braking device for preventing runaway of a ski in the event that the ski boot is disengaged therefrom.

Many ski braking devices of the type described above have been previously proposed. Such ski braking devices are generally made up of a spring wire which is considered desirable because of low material costs. In the ski braking devices which use a spring wire, it is usually required that a relatively long spring wire be used and that the wire be bent into a complicated shape for making up, for example, a brake arm which is extensible below the ski plate, an axial portion which is rotatably supported on the ski plate and an actuating portion for generating and retaining an elastic energy when it is depressed by a ski boot. Accordingly, due to the complicated shape of the spring wire, special attention has to be paid to each of the bending portions. Also, relatively wide open slots or guide spaces are required in the mounting plate for supporting the spring wire or in the pedal member for depressing the spring wire in order to generate the elastic energy required when depresed by the ski boot. The slots or guide spaces in the mounting plate or pedal member will allow snow or mud which becomes attached to the sole of the ski boot to enter freeze therein, and as a result the desired operation of the ski braking device is disturbed.

Also, in the known ski braking device, the design in such that the brake arms thereof can absorb the severe shock which is applied thereto in the normal braking direction. However, when a skier falls down while skiing, there sometimes occurs the situation that a severe shock is applied to the brake arms in an unexpected direction, for example in the direction reverse to the normal braking direction. In such a case, if no special means is provided in the ski braking device for absorbing the shock in the unexpected direction, the brake arms will be deformed permanently or will be broken. Accordingly, it has been desired to provided such a special means for absorbing the shock which is applied in the unexpected direction.

SUMMARY OF THE INVENTION

An object of the present invention is, therefore, to provide a ski braking device in which a special means for absorbing a shock applied in the unexpected direction is compactly contained in the device.

Another object of the present invention is to provide a ski braking device of the type set forth above in which a spring wire having short length is used separate from the brake arm for actuating the device.

Still another object of the present invention is to provide a ski braking device of the type set forth above in which the actuating parts of the device as well as the shock absorbing device are contained snugly in a closed space so as to not allow any snow or mud to enter therein.

A further object of the present invention is to provide a ski braking device of the type set forth above which is low in material cost and simple in structure.

According to the present invention, a ski braking device is provided which includes a base plate, a brake member which is rotatably supported by the base plate at a first bearing portion thereon and having a brake arm which extends along the side edge of the ski plate and is capable of extending below the lower surface of the ski plate in an operative position, a pedal member which is connected to the brake member at one end portion thereof which is opposite to the brake arm, and a metal member which slidably extends from the base plate into a hollow space in the pedal member for allowing the pedal member to move relative to the metal member. The metal member is made up of a metal rod and has a first end portion which is rotatably supported by the base plate at a second bearing portion thereof, which is spaced a predetermined distance from the first bearing portion in the lengthwise direction of the ski plate, and a second free end portion which extends into the hollow space in the pedal member and is hooked or bent toward the side edge of the ski plate. The pedal member includes first and second elastic pressure exerting members in the hollow space for sandwiching the second free end portion of the metal member between them. The first elastic pressure exerting member acts against the second free end portion of the metal member when the pedal member is depressed, and the second elastic pressure exerting member acts against the second free end portion of the metal member when an unexpected shock is applied to the brake arm in the direction which rotates the pedal member opposite to the normal depressing direction.

Preferably, the metal member is formed of a spring wire which is bent substantially in the shape of "V" at the second free end portion thereof. The first elastic pressure exerting member is a projection which is located in the hollow space in the pedal member for deforming the second free end portion of the spring wire to retain an elastic energy therein when the pedal member is depressed.

In another preferred construction, the second pressure exerting member is a compressible coil spring which is located in the hollow space at the inner side of the V-shaped free end portion of the spring wire.

Other objects and features of the present invention will become apparent from the detailed description of the preferred embodiments thereof when taken with reference to the accompanying drawings, in which:

DETAILED DESCRIPTION OF THE INVENTION

Figure 1:
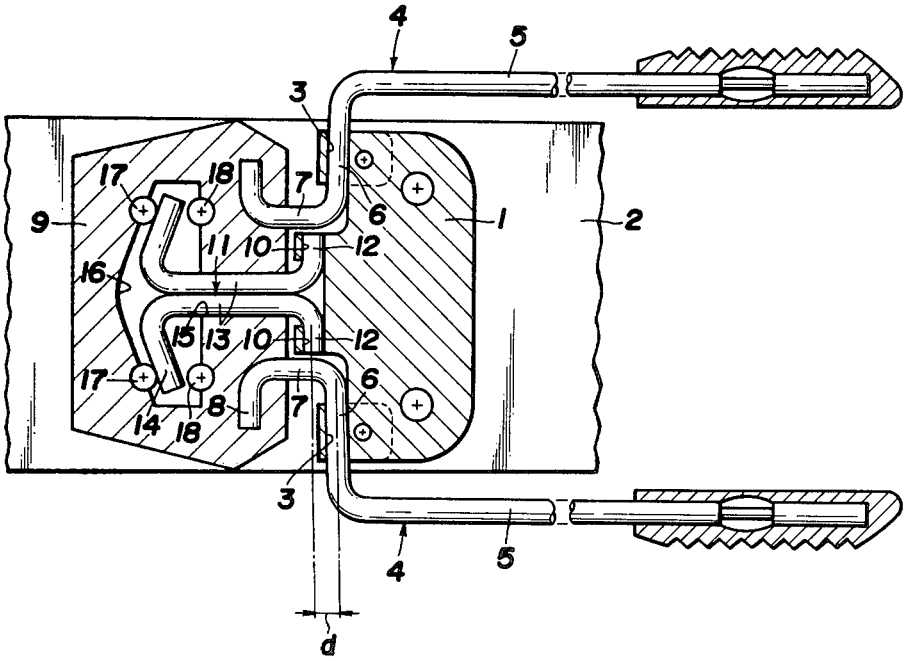
FIG. 1 is a partially sectioned plan view of a ski braking device according to a first embodiment of the present invention.

Referring now to a preferred embodiment of the present invention as shown in FIG. 1, the ski brake includes a base plate 1 which is mounted on a ski plate 2. There is provided on the base plate 1, in the transverse direction of the ski plate, a pair of hollow bearing portions 3—3 for brake members 4—4. Each brake member 4 is formed by bending a metal rod and includes a brake arm 5 which extends along the side edge of the ski plate 2, an axial portion 6 which is at right angles with respect to the brake arm and which extends through the bearing portion 3 on the base plate 1, a neck portion 7 at right angles with respect to the axial portion 6 and which extends therefrom in the opposite direction from the brake arm 5, and a terminal end 8 at right angles with respect to the neck portion 7 toward the side edge of the ski plate 2.

Provided adjacent to the base plate 1 is a pedal member 9 in which a part of the neck portion 7 and the terminal end 8 of each brake member 4 are embedded, whereby the pedal member 9 is integrally connected to one end portion of the brake members 4—4.

The base plate 1 also has second hollow bearing portions 10—10 which are integral therewith between the first bearing portions 3—3 in the transverse direction of the ski plate 2. The second bearing portions 10—10 are spaced from the first bearing portions 3—3 by a distance of "d" in the lengthwise direction of the ski plate 1 as shown in FIG. 1. In this embodiment, the second bearing portions 10—10 are located so as to be closer to the pedal member 9 than the first bearing portions 3—3. Rotatably supported by the second bearing portions 10—10 are a pair of spring wires 11—11. More particularly, one end 12 of each spring wire 11 is bent in the transverse direction to the ski plate 2 and rotatably inserted into the second bearing portions 10. The spring wire 11 further includes a longitudinal straight portion 13 which extends in the lengthwise direction of the ski plate and an elastic hooked free end portion 14 which is bent outwardly in the shape of "v" toward the side edge of the ski plate. The straight portion 13 of the spring wire 11 extends through the longitudinal hollow channel 15 in the pedal member 9 and is slidable therewith. The pedal member 9 also has a relatively wide closed hollow space 16 therein in which the elastic hooked free end portions 14—14 of the spring wires 11 are slidably inserted. The hollow space 16 has first elastic pressure exerting members for urging the hooked end portions 14 toward the second bearing portions 10—10 when the pedal member 9 is depressed by the sole of a ski boot (not shown) and second elastic pressure exerting members for urging the hooked end portions 14 in the opposite direction to the first elastic pressure exerting members when a shock is applied to the brake arms in the direction opposite to the normal braking direction.

In the embodiment shown in FIGS. 1, the first and second elastic pressure exerting members are first and second projections 17 and 18, respectively, which are located in the hollow space 16 so as to sandwich each hooked free end portion 14 of the spring wire 11 between each other. The first projection 17 provided so as to act against the outer surface of the hooked free end portion 14 to elastically bend the portion 14 inwardly toward the straight portion 13 when the pedal member 9 is pressed down by a ski boot. On the other hand, the second projection 18 is provided so as to act against the inner surface of the hooked end portion 14 and to cause the hook shape of the portion 14 to expand outwardly toward the first projection 17 when the brake arms 5—5 are rotated in the direction opposite to the normal braking direction.

The operation of the ski brake of the present invention will now be described with reference to FIGS. 2 and 3. In the position shown by solid line in FIG. 2 when no pressure is applied to the pedal member 9 by a ski boot, the arms 5—5 of the brake members 4—4 project downwardly below the ski plate 2. Further, the hooked free end portions 14—14 of the spring wires 11—11 lightly contact the first projections 17—17 lightly, as shown in FIG. 3(*a*).

When the pedal member 9 is pressed down by a ski boot when the ski boot is secured to a heel binding, the pedal member 9 rotates about the axial portion 6—6 of the brake members 4—4 since the pedal member 9 is integrally connected to the terminal ends 8—8 of the brake members. As a result of the rotation of the pedal member 9, the spring wires 11—11 are also rotated together with the pedal member 9. However, the axis of rotation of each spring wire 11 is at one end 12 thereof which is spaced from the axial portion 6 of the brake member 4 by a distance of "d" in the lengthwise direction of the ski plate. Accordingly, when the pedal member is rotated toward the upper surface of the ski plate 2, the hooked free end portions 14—14 of the spring wires 11—11 extend deeply into the hollow space 16 in the pedal member. At this time, each hooked free end portion 14 of the spring wire is forced against the first projection and, thereby, deformed inwardly toward the longitudinal straight portion 13 thereof, as shown in FIG. 3(*b*). Thus, elastic energy is stored at these deformed hooked free ends 14—14 of the spring wires when the pedal member is depressed by the ski boot, to a position where the brake arms 5—5 of the brake members 4—4 are raised above the ski plate 2 as shown by a dot-dash line in FIG. 2.

When the ski boot is disengaged from the heel and toe bindings and, therefore, when the depressing force on the pedal member is removed therefrom, the elastic energy which has been stored at the deformed hooked free end of each spring wire 11 is released to cause the pedal member 9 to rotate about the axial portion 6—6 of the brake members 4—4. During this rotation, the pedal member 9 slides along the longitudinal straight portions 13 of the spring wires away from the axial end portions 12—12 thereof, so that the hooked free end portions 14—14 of the spring wires which are contacting the first projections 17—17 are expanded outwardly to the position shown in FIG. 3(*a*) from the position shown in FIG. 3(*b*). Thus, the present ski brake becomes operative as shown by the solid line in FIG. 2.

Figure 2:
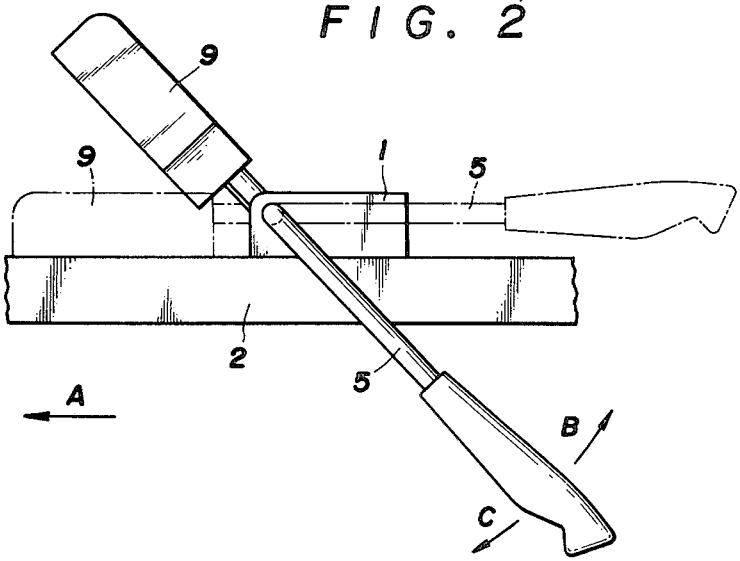
FIG. 2 is a side view of the ski braking shown in FIG. 1.
Figure 3A:
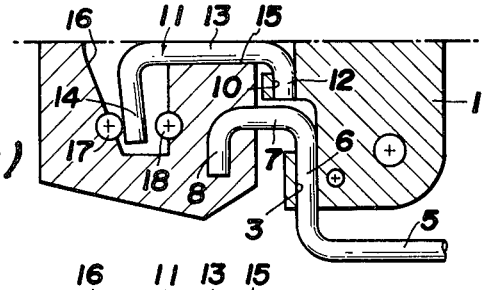
FIG. 3(*a*) through FIG. 3(*c*) are plan views in cross-section of a part of the ski braking device of FIG. 1 for explanation of the operation thereof.
Figure 3B:
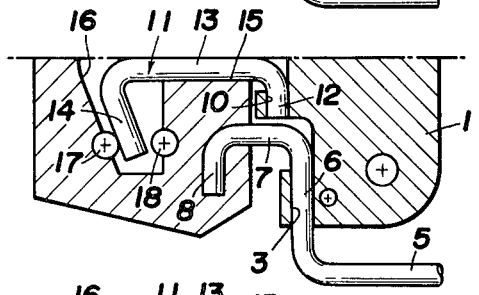
Figure 3C:
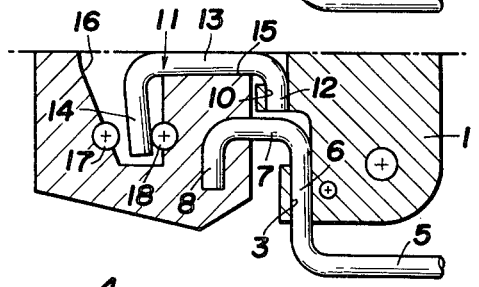

In the position shown in FIG. 2, arrow A denotes the direction in which in a normal runaway the ski plate 2 will travel. Accordingly, when the brake arms 5—5 are projecting into snow to prevent runaway of the ski plate 2, a force is exerted by the snow to the brake arms 5—5 in the direction shown by arrow "B". However, the arms 5—5 cannot be rotated to the direction "B" by such a force, as a result of the hooked free end portions 14—14 of the spring wires 11—11 having a predetermined diameter and resulting spring constant so as to not be easily deformed by a small force. Usually, the brake arms 5—5 are capable rotate in the direction of "B" only when the pedal member 9 is depressed by the sole of the ski boot.

However, when a skier falls accidentally in skiing, there occurs the situation where an abnormally high shock is applied to the arms 5—5 of the brake members 4—4 in the opposite direction shown by arrow "C", for example in case the ski runs away in the reverse direction relative to the normal skiing direction. In this case, the hooked free end portions 14—14 of the spring wires 11—11 are forced against the second projections 18—18 in the hollow space 16, so that the hooked end 14 of each spring wire 11 is outwardly expanded so as to have a larger angle at the hooked corner, as shown in FIG. 3(*c*). Thus, an abnormal shock which is applied to the arms of the brake members in the direction of "C" can be absorbed elastically.

As can be understood from the disclosure set forth above, according to the ski brake of the first embodiment of the present invention, the brake arms 5—5 which have a relatively long length can be made of usuall metal rods, whereas the means for actuating the brake arms are made of spring wires having short length. Accordingly, it is unnecessary in the ski brake of the present invention to bend long spring wires into a complicated shape. Thus, not only are the material cost but also the production cost of the present ski brake are remarkably reduced when compared with the conventional ski brakes.

Another advantage of the present ski brake as set forth above resides in the fact that the means for generating the elastic energy to actuate the brake arms 4—4 as well as means for elastically absorbing the accidental shock applied to the brake arms in the unexpected direction is provided compactly in the closed hollow space 16 in the pedal member 9. This makes the structure of the present ski brake simple and reliable since no snow, ice or mud can enter into the hollow space 16. Further, due to the provision of the means for elastically absorbing the accidental shock, the undesirable permanent deformation of the brake arms, which will make the ski brake inoperative, can be avoided.

Figure 4:
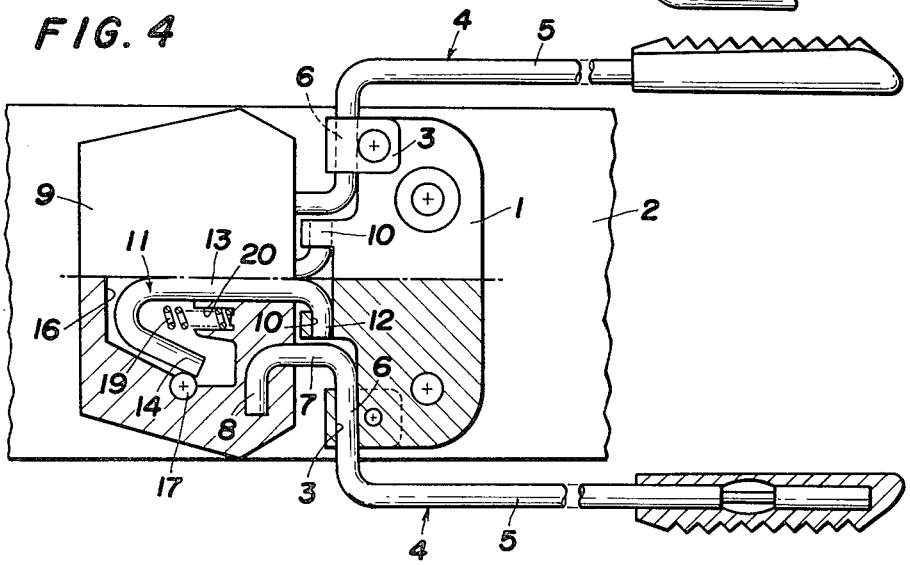
FIG. 4 is a partially sectioned plan view of a ski braking device according to a second embodiment of the present invention.
Figure 5:
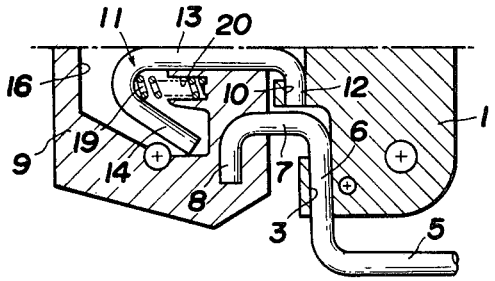
FIG. 5 is a plane view in cross-section of a part of the ski braking device of FIG. 4 in the case when an unexpected shock is applied to the brake arms in the direction opposite to the normal braking direction.

Reference is now made to a second embodiment of the present invention as shown in FIGS. 4 and 5, in which the same reference numerals designate the same parts as the first embodiment shown in FIGS. 1 to 3. In a ski brake according to the second embodiment, small coil springs 19—19 are provided in the hollow space 16 in the pedal member 9 in place of the second projections 18—18 of the first embodiment. More particularly, each coil spring 19 is disposed between the longitudinal straight portion 13 and the hooked free end 14 of the spring wire 11. One end portion of the coil spring 19 is contained in a cavity 20 in the pedal member 9, while the other end of the coil spring 19 is normally separated slightly from the inner corner of the hooked free end portion of the spring wire. The coil spring 19 is of the kind which shows elasticity when compressed in the axial direction thereof. The remaining structure of the ski brake according to the second embodiment as shown in FIGS. 4 and 5 is substantially the same as that of the first embodiment shown in FIGS. 1 to 3.

In the ski brake of the second embodiment, when the abnormal shock is applied to the arms 5—5 of the brake members 4—4 in the direction of "C" shown in FIG. 2, the inner corner of the hooked free end portion of each spring wire compresses the coil spring 19, as shown in FIG. 5. This results in the abnormal shock applied to the brake arms 5—5 in the unexpected direction being elastically absorbed by the coil springs 19—19 to prevent permanent deformation of the brake arms or breakage of the pedal member 9 which in this invention may be made of a plastic material.

Figure 6:
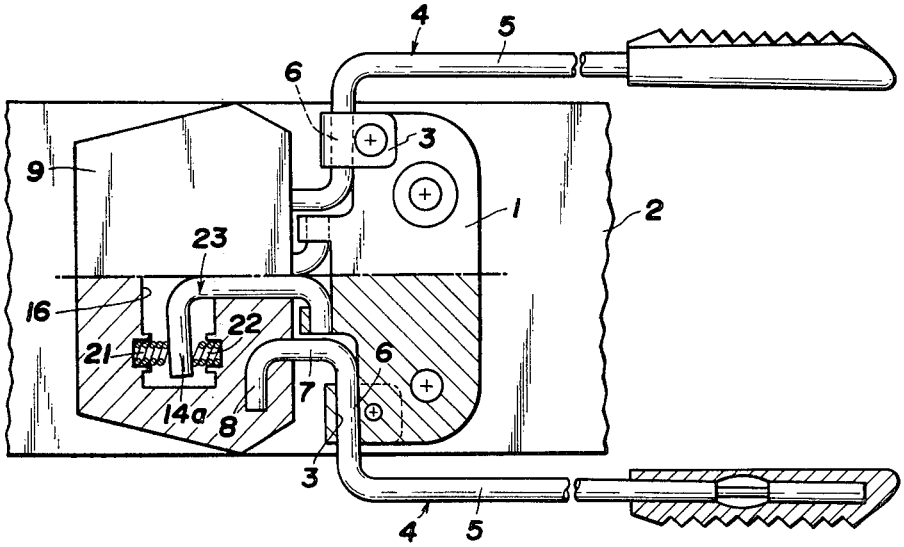
FIG. 6 is a partially sectioned plan view of a ski braking device according to a third embodiment of the present invention.

Reference is now made to a third embodiment of the present invention which is shown in FIG. 6, in which the same reference numerals have been applied to the same parts as the first and second embodiments. In a ski brake according to the third embodiment, first and second small coil springs 21 and 22 are provided in the hollow space 16 of the pedal member 9 which sandwich the hooked free end portion 14 of each metal wire 23 which may be or may not be a spring wire. These first and second coil springs 21 and 22 are provided in place of the first and second projections 17 and 18, respectively, in the first embodiment are compressible along each axis thereof. Other structures of the ski brake according to the third embodiment shown in FIG. 6 are substantially same as those of the first embodiment shown in FIGS. 1 to 3.

When the pedal member 9 is pressed down by a ski boot, the hooked free end portion 14*a* of each metal wire 23 extends deeply into the hollow space 16 in the pedal member, whereby the first coil spring 21 is compressed by the hooked free end portion 14*a* of the metal wire to retain an elastic energy therein. In the event that the ski boot is removed from the pedal member 9, the pedal member as well as the brake arms 4—4 connected thereto are rotated into the ski braking position by the action of the first coil springs 21—21. On the other hand, when the abnormal shock is applied to the brake arms 5—5 in the direction of "C" shown in FIG. 2, the hooked free end portions of each metal wire 23 compress the second coil springs 22 which to elastically absorb the shock as in the case of second embodiment.

Although the present invention has been described with reference to the preferred embodiments thereof, many other modifications and alterations may be made within the spirit of the present invention.

What is claimed is:

1. A ski braking device comprising:

a base plate adapted for mounting on a ski plate;

a brake member rotatably supported on said base plate, said base plate having first bearing means for supporting said brake member and said brake member having brake arms located along the side edges of said ski plate wherein said brake arms are capable of extending below the lower surface of said ski plate when said ski brake is in an operative position;

a pedal member connected to said brake member at one end thereof opposite to said brake arms, said pedal member having a hollow interior;

a metal member slidably extending into said hollow interior, said base plate having second bearing means spaced a predetermined distance from said first bearing means, said metal member comprising a metal rod having a first end portion rotatably supported at said second bearing means and a second free end portion extending into said hollow interior of said pedal member, said second free end portion being bent toward the side edge of said ski plate; and first elastic pressure means and second elastic pressure means located in said hollow interior of said pedal member for having said second free end portion positioned therebetween, said first elastic pressure means biasing said metal member at said second free end portion for having said brake arms move into operative position when the ski binding releases from the ski boot and said second elastic pressure means for biasing said metal member at said second free end portion in a direction opposite to the direction of biasing of said first elastic pressure means for having said metal member absorb an unexpected shock resulting from a force being exerted on said brake arms in a direction opposite to the normal direction of movement of said brake arms when said brake arms are moved into an inoperative position.

2. A ski braking device as claimed in claim 1, wherein said metal rod comprises a spring wire which is bent substantially in the shape of "V" at said second free end portion thereof; and said first elastic pressure means comprises a first projection located in said hollow space in said pedal member for deforming said second free end portion of said spring wire causing said spring wire to retain an elastic energy therein when said pedal member is depressed.

3. A ski braking device as claimed in claim 2, wherein said second pressure means comprises a compressible coil spring located in said hollow space at the inner side of the V-shaped free end portion of said spring wire.

4. A ski braking device as claimed in claim 2, wherein said second pressure means is a second projection located in said hollow space opposite to said first projection.

5. A ski braking device as claimed in claim 1, wherein said metal member comprises a metal rod bent outwardly at said second free end portion thereof; and said first and second elastic pressure means are a pair of coil springs located in said hollow space for sandwiching said free end portion of said metal rod therebetween.

* * * * *